US010993291B2

(12) United States Patent
Schlipf

(10) Patent No.: US 10,993,291 B2
(45) Date of Patent: Apr. 27, 2021

(54) ELECTRICAL DEVICE WITH INSULATOR BODY

(71) Applicant: TÜRK & HILLINGER GMBH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 322 days.

(21) Appl. No.: 15/927,214

(22) Filed: Mar. 21, 2018

(65) Prior Publication Data

US 2019/0098704 A1 Mar. 28, 2019

(30) Foreign Application Priority Data

Mar. 22, 2017 (DE) ..... 20 2017 101 662.5

(51) Int. Cl.

| | |
|---|---|
| ***H05B 3/44*** | (2006.01) |
| ***H05B 3/52*** | (2006.01) |
| ***H05B 3/48*** | (2006.01) |
| ***H01B 7/16*** | (2006.01) |

(52) U.S. Cl.

CPC ..... *H05B 3/52* (2013.01); *H01B 7/16* (2013.01); *H05B 3/48* (2013.01)

(58) Field of Classification Search

CPC ..... H05B 2203/016; H05B 3/06; H05B 3/18; H05B 3/40–48; H05B 3/68; H05B 3/52; H01B 7/16

USPC ..... 219/523, 534–544; 338/238–243

See application file for complete search history.

(56) References Cited

U.S. PATENT DOCUMENTS

| | | | | |
|---|---|---|---|---|
| 2,219,523 A | | 10/1940 | Lampe et al. | |
| 3,080,543 A | * | 3/1963 | Boggs | H05B 3/48 338/273 |
| 3,134,956 A | * | 5/1964 | Boggs | H05B 3/06 338/273 |
| 3,512,114 A | * | 5/1970 | Dzaack | H05B 3/48 338/241 |
| 4,182,948 A | * | 1/1980 | Markum | H05B 3/48 219/458.1 |
| 6,104,011 A | * | 8/2000 | Juliano | G01K 7/04 219/544 |
| 2002/0047002 A1 | * | 4/2002 | Wheeler | H05B 3/44 219/243 |

FOREIGN PATENT DOCUMENTS

| | | |
|---|---|---|
| CN | 2938681 Y | 8/2007 |
| CN | 101772986 A | 7/2010 |
| CN | 101778500 A | 7/2010 |
| CN | 102137521 A | 7/2011 |

(Continued)

*Primary Examiner* — Sang Y Paik

(74) *Attorney, Agent, or Firm* — McGlew and Tuttle, P.C.

(57) ABSTRACT

An electrical device (100, 200) is provided with a tubular metal sheath (110, 210, 250, 260) and with an insulator body (120, 160, 220, 251, 261), which is arranged in the interior of the tubular metal sheath (110, 210, 250, 260) and through which passes at least one tunnel-like opening (tunnel opening) (121, 122, 161, 162, 221, 252, 262). At least one section (131*a*, 132*a*, 171*a*, 172*a*) of a first electrical conductor (131, 132, 171, 172, 231) is arranged in the tunnel opening (121, 122, 161, 162, 221, 252, 262), in which the cross-sectional geometry of the tunnel opening (121, 122, 161, 162, 221, 252, 262) deviates from a circular shape.

20 Claims, 5 Drawing Sheets

(56) References Cited

FOREIGN PATENT DOCUMENTS

| | | | |
|---|---|---|---|
| CN | 103460793 | A | 12/2013 |
| CN | 203942660 | U | 11/2014 |
| CN | 104254154 | A | 12/2014 |
| CN | 105323884 | A | 2/2016 |
| CN | 205491236 | U | 8/2016 |
| CN | 106455167 | A | 2/2017 |
| DE | 829 480 | C | 1/1952 |
| DE | 18 05 220 | U | 2/1960 |

* cited by examiner

ELECTRICAL DEVICE WITH INSULATOR BODY

CROSS REFERENCE TO RELATED APPLICATIONS

This application claims the benefit of priority under 35 U.S.C. § 119 of German Application 20 2017 101 662.5, filed Mar. 22, 2017, the entire contents of which are incorporated herein by reference.

FIELD OF THE INVENTION

The present invention pertains to an electrical device with a tubular metal sheath, with an insulator body, which is arranged in the interior of the tubular metal sheath and through which at least one tunnel-like opening (a tunnel opening) passes, wherein at least one section of a first electrical conductor is arranged in the tunnel-like opening.

BACKGROUND OF THE INVENTION

Such electrical devices include, for example, sheathed thermocouples and electrical heating cartridges, in which sections of thermocouple wire legs or electrical heating elements, especially resistance wires, extend in holes, i.e., tunnel-like openings with a circular cross section, of a coil body arranged in the interior of a tubular metallic sheath, and are possibly also indirectly or directly connected to connecting lines or connecting wires in the interior of the holes.

It is seen in practice that this long-established structural shape is less and less able to meet the steadily increasing requirements imposed on such electrical devices, especially electrical heating devices and reaches its limitations. For example, ever-increasing heating outputs are required to be accommodated in an increasingly smaller space available for installation, without the reliable function being jeopardized.

SUMMARY OF THE INVENTION

An object of the present invention is therefore to provide an electrical device with improved configuration, with which it is possible to utilize the space available for installation better than before and/or to increase the reliability of the electrical device.

The electrical device according to the present invention has a tubular metal sheath and an insulator body, which is arranged in the interior of the tubular metal sheath and through which at least one tunnel-like opening (tunnel opening) passes, wherein at least one section of a first electrical conductor is arranged in the tunnel-like opening.

It is noted for the sake of clarity that a tubular metal sheath does not necessarily have to have a circular cross section, but the cross section is freely selectable.

The term "tunnel-like opening" or tunnel opening is defined here as an opening that passes through the insulator body from one end face to the other, i.e., essentially in the direction in which the tubular metal sheath extends. One example is, for example, a hole, which passes through the insulator body in electrical devices known from the state of the art; contrary to the obligatorily circular cross section of a hole, the cross section of a tunnel-like opening is, however, freely selectable.

The present invention is also geared precisely to this, because it is essentially according to the present invention for the cross-sectional geometry of the tunnel-like opening to deviate from a circular shape. This measure, which can be embodied especially by the use of extrusion methods, but also by the injection molding of ceramics, makes possible a better utilization of the space available in case of the given geometry of the component and can make a substantial contribution to facilitating the accurate positioning of the sections of electrical conductors, which are arranged in the interior of the tunnel-like opening.

The inventor recognized that the hitherto common, circular cross section of holes as a tunnel-like opening entails a number of drawbacks, whose relevance varies depending on the particular applications.

It is only in the rarest cases with a possible cross-sectional area of the electrical device, which is predefined by the space available for installation, for a hole having a circular cross section to be suitable for enabling the use of the largest possible conductor cross section. This conductor cross section is, however, desirable in order to enable high currents to be transported with low losses with a low load.

Further, there are cases in which an unheated zone shall be formed, so that it is important to be able to accommodate a maximum conductor cross section in case of predefined maximum dimensions. It often happens that the cross sections that can be obtained according to the state of the art are not large enough in this case, either, depending on the particular geometry, and can easily be surpassed by the configuration according to the present invention.

The area given away due to the tunnel-like opening configured as a hole with circular cross section is typically especially large in cases in which the space available for installation is limited due to the use in only one dimension.

Since the circular cross section represents the geometry that has the smallest circumference for a given area, conductor sections that fill the greatest possible circular hole as much as possible likewise have a circular cross section. However, this leads to a higher surface load than in the case of conductors that have an equal cross-sectional area but a different cross-sectional shape.

This discovery can be directly applied to electrical devices in which a coiled resistance wire was hitherto arranged in the tunnel-like opening configured as a hole with a circular cross section. At equal cross-sectional area, a shape deviating from the circular geometry makes it possible to use a greater heating wire length per turn and thus a higher heat output in case of the maximum number of turns predefined by the predefined length of the electrical device, because more resistance wire is accommodated.

In cases in which the opening shall be filled with an electrical insulator, e.g., magnesium oxide, deviations of the cross section of the tunnel-like opening from the circular cross section may be used, for example, to fix heating wire coils in the space, as well as to avoid filling problems by being configured as filling openings and facilitating the trickling in of the filler.

Contact problems may also be reduced in many cases by the embodiment of the cross section according to the present invention. If, for example, sections of two different conductors must be arranged within the hole, their positions in the hole are not unambiguously predefined because of the symmetry of their cross sections. If, for example, a pressure contacting is then performed, this difference in the positions in the hole may lead to noticeable differences in the behavior of the contact thus established, especially in respect to the contact resistance of the contact.

For example, the first electrical conductor may be a thermocouple wire leg of a thermocouple or an electrical heating element, e.g., a resistance wire, and the second electrical conductor may be a connecting wire to be connected to the first electrical conductor. The present invention can be used advantageously in these applications as well, because a positioning predefinable by the cross section of the tunnel-like opening often plays an essential role here.

It is especially preferred in this connection if the cross-sectional geometry of the tunnel-like opening is adapted to the cross-sectional geometry of the conductor sections arranged in the tunnel-like opening, the adaptation being especially advantageously such that the conductor sections arranged in the tunnel-like opening are positioned and/or fixed. As a result, an advantageous prepositioning will then take place, which leads to high reproducibility of the electrical properties and of the resulting geometric arrangement of a connection of the conductor sections in relation to one another, which connection is established especially by or during the pressing.

In a variation of this variant, due to the fact that the cross-sectional geometry of the tunnel-like opening is adapted to the cross-sectional geometry of the conductor sections arranged in the tunnel-like opening such that the conductor sections positioned and/or fixed in the tunnel-like opening are arranged essentially in a gap-free manner (with a gap-free configuration) in relation to one another, insulator powder is prevented from slipping in between conductor sections to be contacted with one another when the electrical device is filled with insulator powder during the manufacture of the electrical device.

Accurately reproducible positionability of the respective conductor can be achieved especially if the cross section of the tunnel-like opening has a circle segment- or sector-shaped section for receiving and fixing a section of the first electrical conductor having a circular cross section and/or a section of the second electrical conductor having a circular cross section.

If the cross section of the tunnel-like opening has a rectangular section for receiving and fixing a section of the first electrical conductor having a rectangular cross section and/or a section of the second electrical conductor having a rectangular cross section, this can also be achieved for angular conductor geometries or for flat strips.

It is important to remember here that a square is a special rectangle.

The cross section of the tunnel-like opening having an angular (i.e., for example, L- or T-shaped) shape or a curved shape, e.g., a kidney shape, may contribute to the optimal utilization of the space available for installation.

It may also be preferred if the cross section of the tunnel-like opening has at least one tapering section. This is a simple possibility for achieving a predefined positioning of two conductors having different cross sections. The tapering may extend, e.g., from right to left or vice versa, from top to bottom or vice versa, or also radially from the inside to the outside or from the outside to the inside.

The electrical device may be, for example, a sheathed thermocouple. As an alternative, the electrical device may be an electrical heating device, especially a heating cartridge or a coiled tube cartridge. Such an electrical device may be, for example, of the class in which the electrical heating device has an electrical heating element, which is wound in at least some sections on the outer circumference of the insulator body and protrudes into the tunnel-like opening in at least some sections; it may, however, also be configured such that the electrical heating element is entirely arranged in the tunnel-like opening.

It may be especially advantageous in electrical devices in which the tunnel-like opening shall be filled with a powder if the cross section of the tunnel-like opening has recesses for filling the tunnel-like opening with a powder, especially with magnesium oxide powder, in order to significantly simplify the filling operation and to improve the process reliability of this operation.

If the cross section of the tunnel-like opening is selected to be such that the ratio of the length of the circumferential line of the cross section to the area of the cross section is maximized for a given installation space, the surface load can be reduced in case of heating wires extending in a stretched form and the length of the heating wire and hence the heat output provided can be optimized in case of coiled heating wires.

It may be advantageous if the first electrical conductor has a variation in its cross section. It is advantageous in this case if the cross section of the tunnel-like opening varies as well.

The present invention will be explained in more detail below on the basis of figures, which show exemplary embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1B:
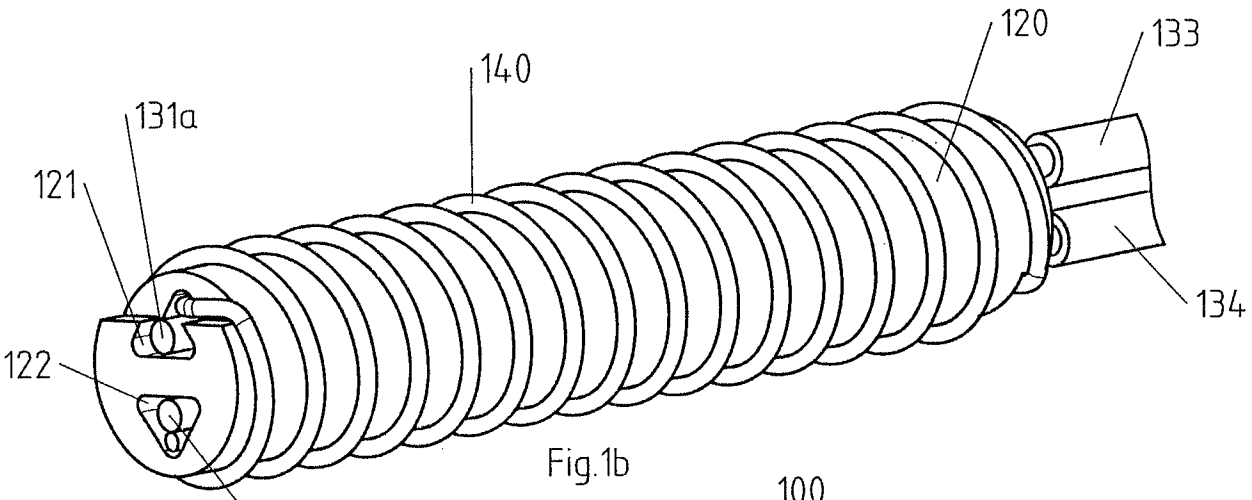
FIG. 1*b* is a perspective view showing the insulator body of the exemplary embodiment from FIG. 1*a* with a first conductor and a second conductor arranged thereon.
Figure 1C:
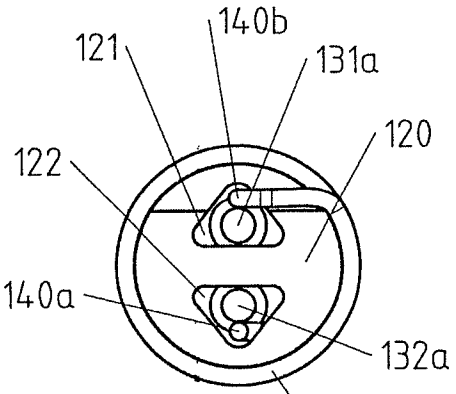
FIG. 1*c* is a cross-sectional view showing the insulator body with a first conductor and a second conductor arranged on the insulator body, taken at right angles in the cross section to the direction in which the insulator body extends.
Figure 1A:
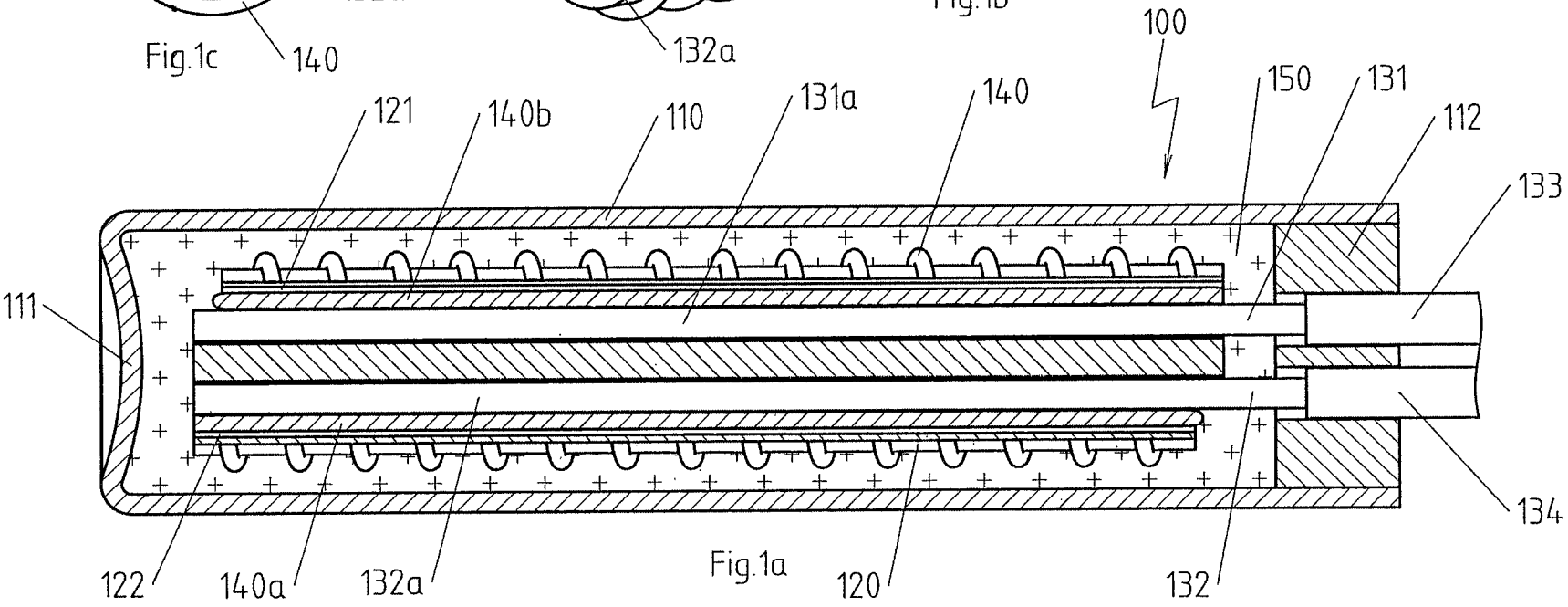
FIG. 1*a* is a cross-sectional view showing an exemplary embodiment of an electrical device in the form of a first heating cartridge.

Referring to the drawings, FIG. 1*a* shows an electrical device 100 configured as a heating cartridge with a tubular metal sheath 110 with a bottom 111 and with an insulator body 120, which is arranged in the interior of the tubular metal sheath 110 and which is embedded in an electrically insulating material 150, e.g., MgO. Electrical supply lines 133, 134 are led through a plug 112 at the end of the tubular metal sheath 110 located opposite the bottom 111. As is also shown in FIGS. 1*b* and 1*c*, two tunnel-like openings 121, 122 pass through the insulator body 120. Respective sections 131*a*, 132*a* of a first electrical conductor 131, 132, which is formed by the current-carrying leads of supply lines 133, 134, are received in the tunnel-like openings 121, 122.

A second electrical conductor 140, the heating element, whose end sections 140*a*, 140*b* likewise pass through the tunnel-like openings 121, 122, extending parallel to the sections 131*a*, 132*a* of the first electrical conductors 131, 132 and are in electrical contact with these, for example, by pressure contacting, is wound on the insulator body 120 on the outside.

As is clearly shown in FIGS. 1*b* and 1*c*, the cross section of the tunnel-like openings 121, 122 is essentially triangular, namely, it has the cross section of a triangle with rounded tips, the triangle being always oriented such that one tip points outwards in the radial direction of the insulator body 120. The end sections 140*a*, 140*b* of the heating elements are arranged in the area of these tips. The sections 131*a*, 132*a* of the current-carrying leads, which have a larger cross section than the heating element, are in contact with the base. The cross section of the tunnel-like openings 121, 122 thus predefines the positioning of the sections of the first electrical conductor 131, 132 and of the second electrical conductor 140, which are received in the tunnel-like opening 121, 122, which leads to improved process reliability of the pressure contacting.

Figure 1D:
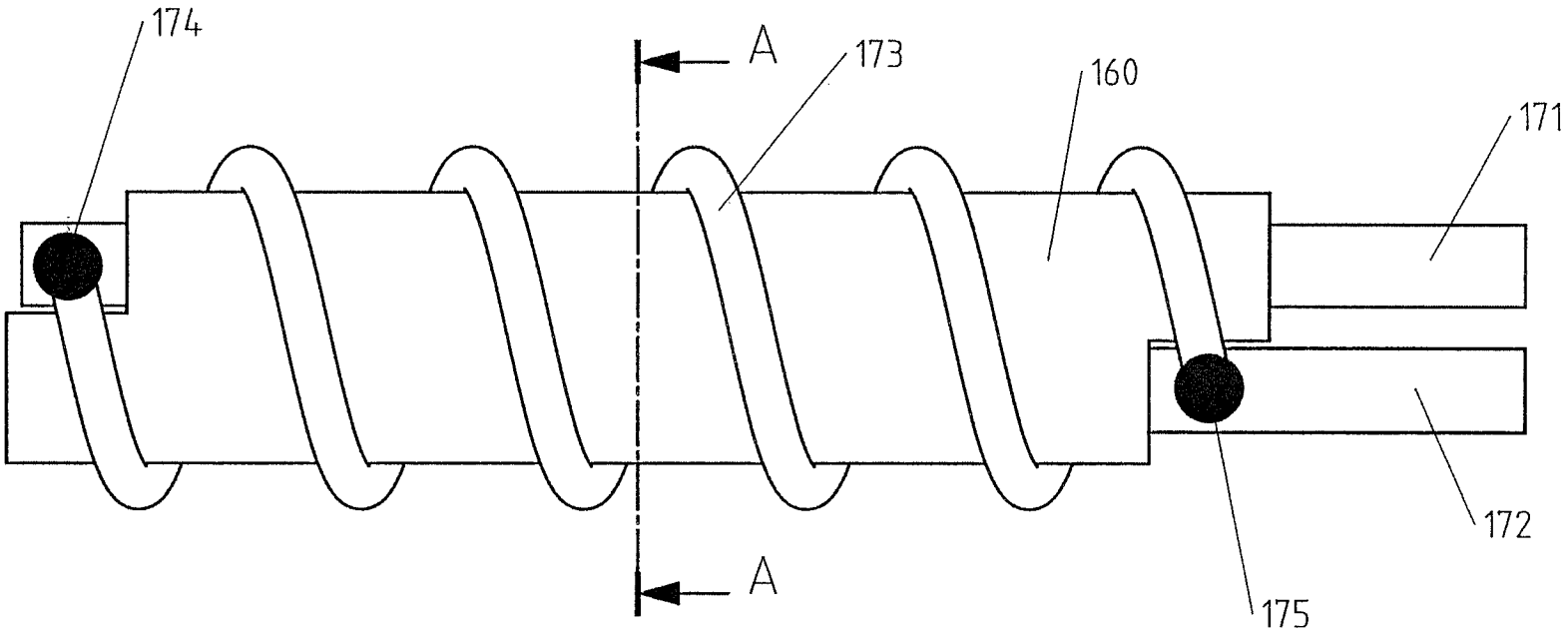
FIG. 1*d* is a side view showing a variant of an inner structure for the exemplary embodiment from FIG. 1*a* with electrical conductors arranged thereon.
Figure 1E:
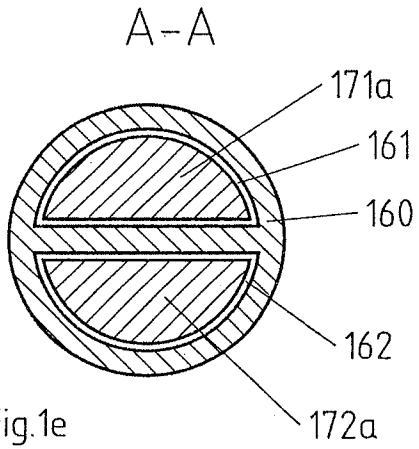
FIG. 1*e* is a cross-sectional view showing the insulator body from FIG. 1*d*, taken at right angles to the direction in which the insulator body extends.

When viewed together with FIG. 1*e*, FIG. 1*d* shows a variant of an inner structure, which variant is especially suitable for high-current applications, for an electrical heating cartridge with an insulator body 160 with tunnel-like openings 161, 162, into which the respective sections 171*a*, 172*a* of a first electrical conductor 171, 172, which is formed by the terminal studs of the heating cartridge, are inserted and through which they pass. The problem of accommodating terminal studs with a maximum cross section in the space available for installation often arises in these applications. This is made possible here by the tunnel-like openings 161, 162 having a circle segment-shaped cross section, i.e., a cross section deviating from the circular shape. The electrical heating element 173 is wound on the outer circumference of the insulator body 160 and is connected at contact points 174, 175 to the terminal studs.

FIGS. 2*a* through 2*k* show a respective cross section each through insulator bodies 300, 310, 320, 330, 340, 350, 360, 370, 380, 390, 400 with tunnel-like openings 301, 302, 311, 312, 321, 322, 331, 332, 341, 342, 343, 344, 351, 352, 353, 354, 361, 362, 371, 372, 381, 382, 391, 392, 401, 402, 403 and 404, in which sections of conductors 305, 306, 315, 316, 325, 326, 335, 336, 337, 345, 346, 347, 355, 356, 365, 366, 375, 376, 377, 385, 386, 395, 396, 405, 406, 407, 408 are received, in order to illustrate the extremely flexible applicability of the present invention in a plurality of concrete installation situations. For example, such configurations may be used to use U-shaped, stretched heating wires with maximum cross sections.

It should be noted in advance that combinations of tunnel-like openings 301, 302, 311, 312, 321, 322, 331, 332, 341, 342, 343, 344, 351, 352, 353, 354, 361, 362, 371, 372, 381, 382, 391, 392, 401, 402, 403 and 404 shown in the different FIGS. 2*a* through 2*k* are, of course, also possible.

In particular, asymmetric combinations are, of course, possible, even though the far overwhelming majority of the examples shown show pairs of symmetrically configured tunnel-like openings 301, 302, 311, 312, 321, 322, 331, 332, 341, 342, 343, 344, 351, 352, 353, 354, 361, 362, 371, 372, 381, 382, 391, 392, 401, 402, 403 and 404.

Figure 2A:
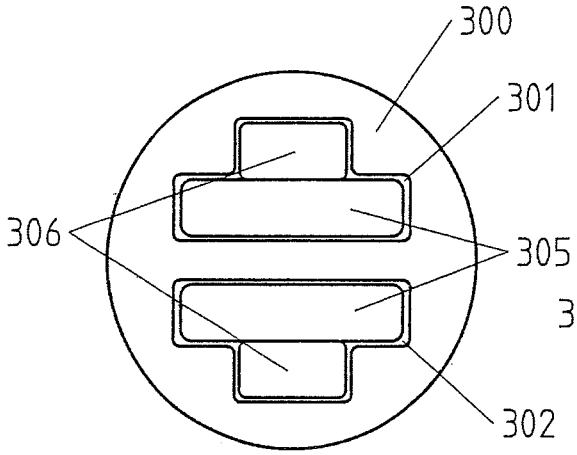
FIG. 2*a* is a cross sectional view showing a first variant, taken through an insulator body at right angles to the direction in which the insulator body extends.

In the embodiment according to FIG. 2*a*, the essentially T-shaped cross-sectional geometry of the tunnel-like openings 301, 302 is adapted to the cross-sectional geometry of the respective conductor sections 305, 306, which are each configured as flat strips and are received in the tunnel-like openings 301, 302. The conductors 306 are likewise arranged and fixed here in a rectangular section of the tunnel-like openings 301, 302.

Figure 2B:
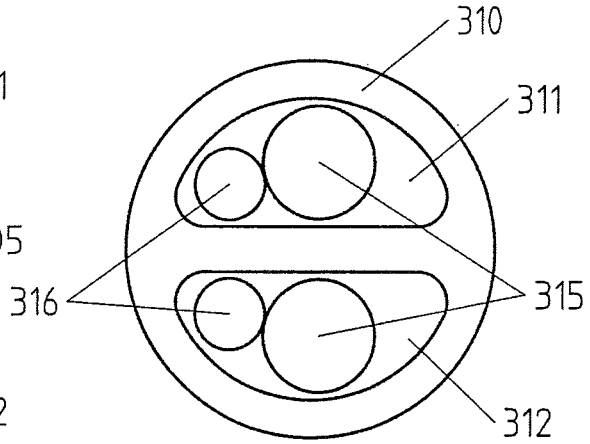
FIG. 2*b* is a cross sectional view showing a second variant, taken through an insulator body at right angles to the direction in which the insulator body extends.

The cross section of the tunnel-like openings 311, 312 is always circle segment-shaped in the embodiment according to FIG. 2*b*, as a result of which a very large available cross section can be provided.

Figure 2C:
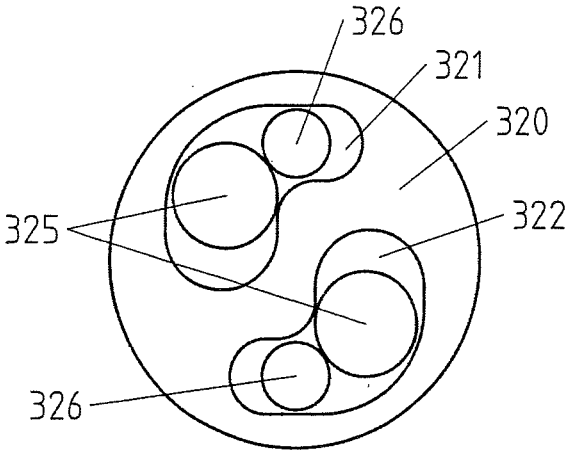
FIG. 2*c* is a cross sectional view showing a third variant, taken through an insulator body at right angles to the direction in which the insulator body extends.

The tunnel-like openings 321, 322 have a curved, kidney-shaped cross section each in the embodiment according to FIG. 2*c*.

Figure 2D:
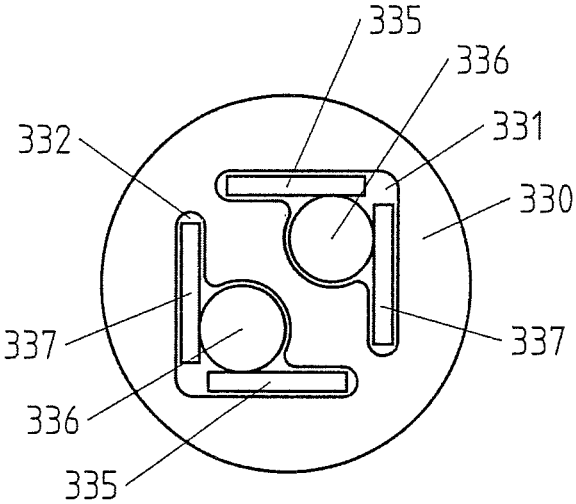
FIG. 2*d* is a cross sectional view showing a fourth variant, taken through an insulator body at right angles to the direction in which the insulator body extends.

In the embodiment according to FIG. 2*d*, the tunnel-like openings 331, 332 have a cross section with an angular basic shape with two rectangular sections directed at right angles to one another, in which respective conductor sections 335, 337 configured as flat strips are received and fixed. In addition, a circle segment-shaped section is present, which receives and fixes the electrical conductor 336. For example, two heating conductors 335, 337 of a switchable heating cartridge can be reliably contacted in this manner with a connection wire 336 in a reliable process.

Figure 2E:
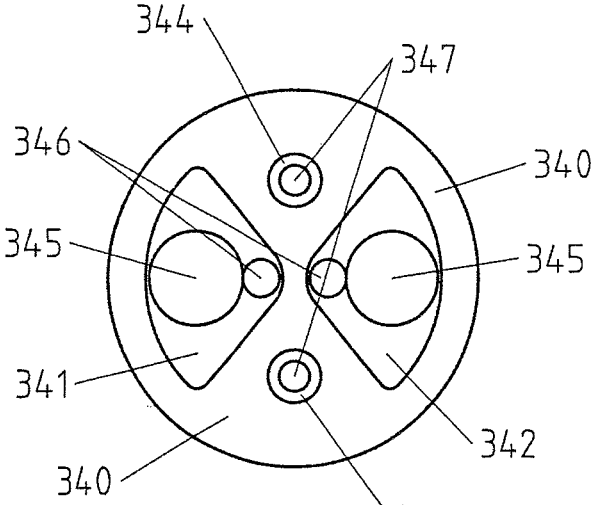
FIG. 2*e* is a cross sectional view showing a fifth variant, taken through an insulator body at right angles to the direction in which the insulator body extends.

In addition to the tunnel-like openings 341, 342, which are circle segment-shaped and thus have a cross section tapering in the radial direction inwards from the outside and in which sections of a first conductor 345 and sections of a second conductor 346 each are connected to one another, two tunnel-like openings 343, 344, which are configured as holes with circular cross section and in which the respective thermocouple wire legs of a thermocouple are received as respective conductors 347, are present in the embodiment according to FIG. 2*e*.

Figure 2F:
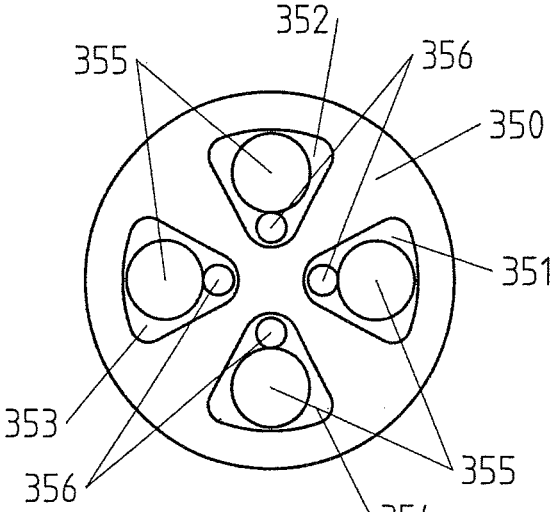
FIG. 2*f* is a cross sectional view showing a sixth variant, taken through an insulator body at right angles to the direction in which the insulator body extends.

The embodiment according to FIG. 2*f* is especially well suited for another variant of a switchable heating cartridge. Respective first sections of a first conductor 355 and sections of a second conductor 356 are connected here to one another in four tunnel-like openings 351, 352, 353, 354, which have a sector-shaped cross section, which thus tapers in the radial direction from the outside to the inside.

The embodiment according to FIG. 2*f* is characterized in that the cross sections of the tunnel-like openings 361, 362 allow for the connection of an electrical conductor 365 with a large cross section, which is configured as a flat strip, to a conductor 366, whose cross section is much smaller and is circular. Accurate positioning of the conductors 365, 366 relative to one another and hence a much better reproducibility of their electrical contacting with one another and of their properties are achieved in case of such configurations as well due to a circle segment-shaped section of the cross section of the tunnel-like openings 361, 362, in which the respective conductor 366 is received and fixed.

Figure 2G:
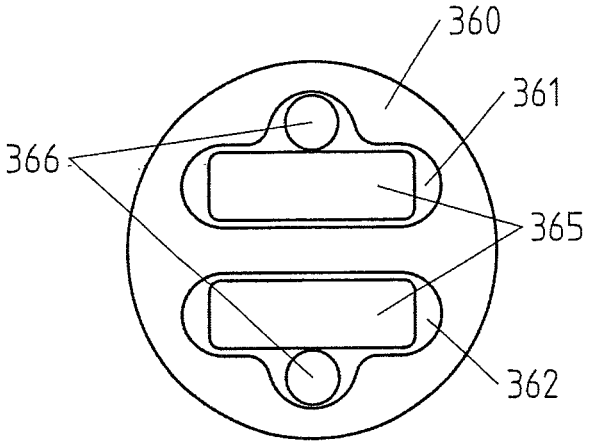
FIG. 2*g* is a cross sectional view showing a seventh variant, taken through an insulator body at right angles to the direction in which the insulator body extends.
Figure 2H:
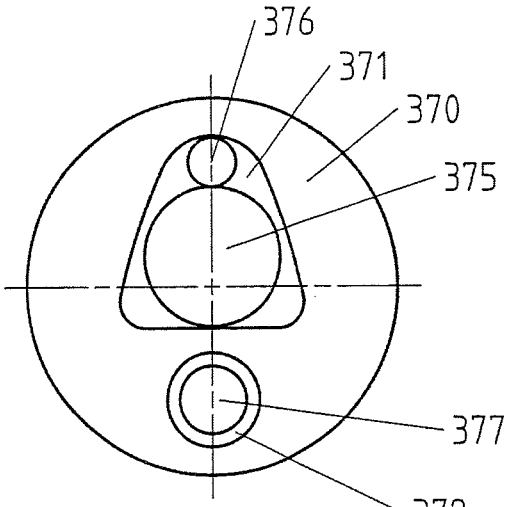
FIG. 2*h* is a cross sectional view showing an eighth variant, taken through an insulator body at right angles to the direction in which the insulator body extends.

The embodiment according to FIG. 2*g* has a tunnel-like opening 371, whose cross section resembles the cross section parallel to the central axis through a truncated cone with rounded corners and tapers radially outwards. Conductors 375, 376 are brought into connection with one another in this opening 371. In addition, yet another tunnel-like opening 372 with circular cross section is present, into which, e.g., a thermocouple can be inserted as a conductor 377.

Figure 2I:
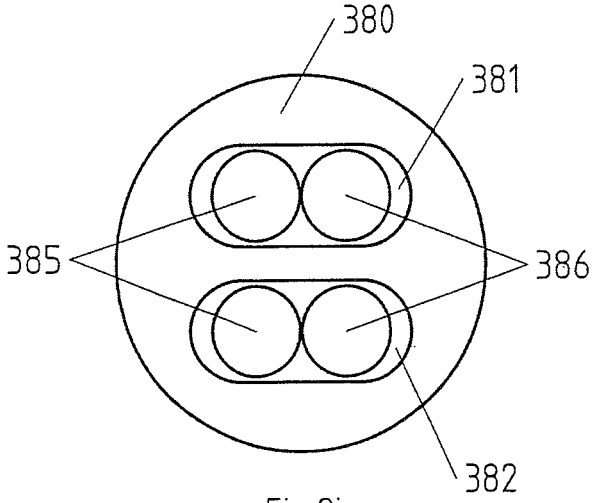
FIG. 2*i* is a cross sectional view showing a ninth variant, taken through an insulator body at right angles to the direction in which the insulator body extends.
Figure 2J:
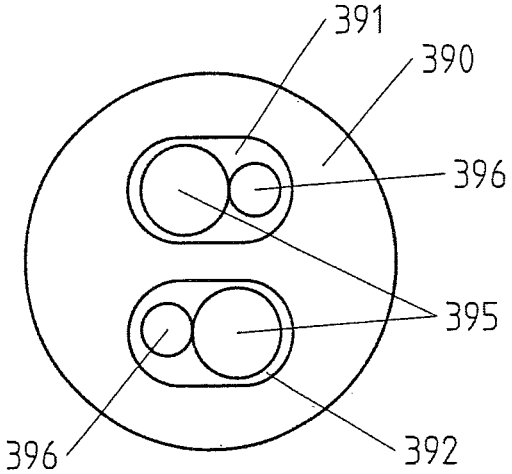
FIG. 2*j* is a cross sectional view showing a tenth variant, taken through an insulator body at right angles to the direction in which the insulator body extends.

The embodiments according to FIGS. 2*i* and 2*j* show respective tunnel-like openings 381, 382 as well as 391, 392 with oval cross section. The longitudinal axis of the oval is always adapted to the cross sections of the respective electrical conductors 385, 385 as well as 395, 396.

Figure 2K:
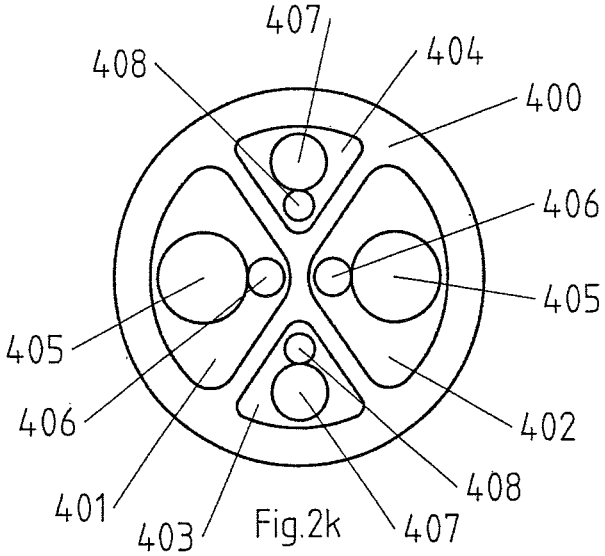
FIG. 2*k* is a cross sectional view showing an eleventh variant, taken through an insulator body at right angles to the direction in which the insulator body extends.

The embodiment according to FIG. 2*k* is an asymmetric variant of the embodiment according to FIG. 2*f*. Respective first sections of a first conductor 405 and sections of a second conductor 406 are connected to one another here in two tunnel-like openings 401, 402 whose cross section is sector-shaped and hence tapers in the radial direction from the outside to the inside, while respective first sections of a first conductor 407 and sections of a seconded conductor 408 are connected to one another in two additional tunnel-like openings 403, 404, whose cross section is sector-shaped and hence tapers in the radial direction from the outside to the inside, wherein the size of the sectors is adapted to the cross section of the conductors received in them.

Figure 3A:
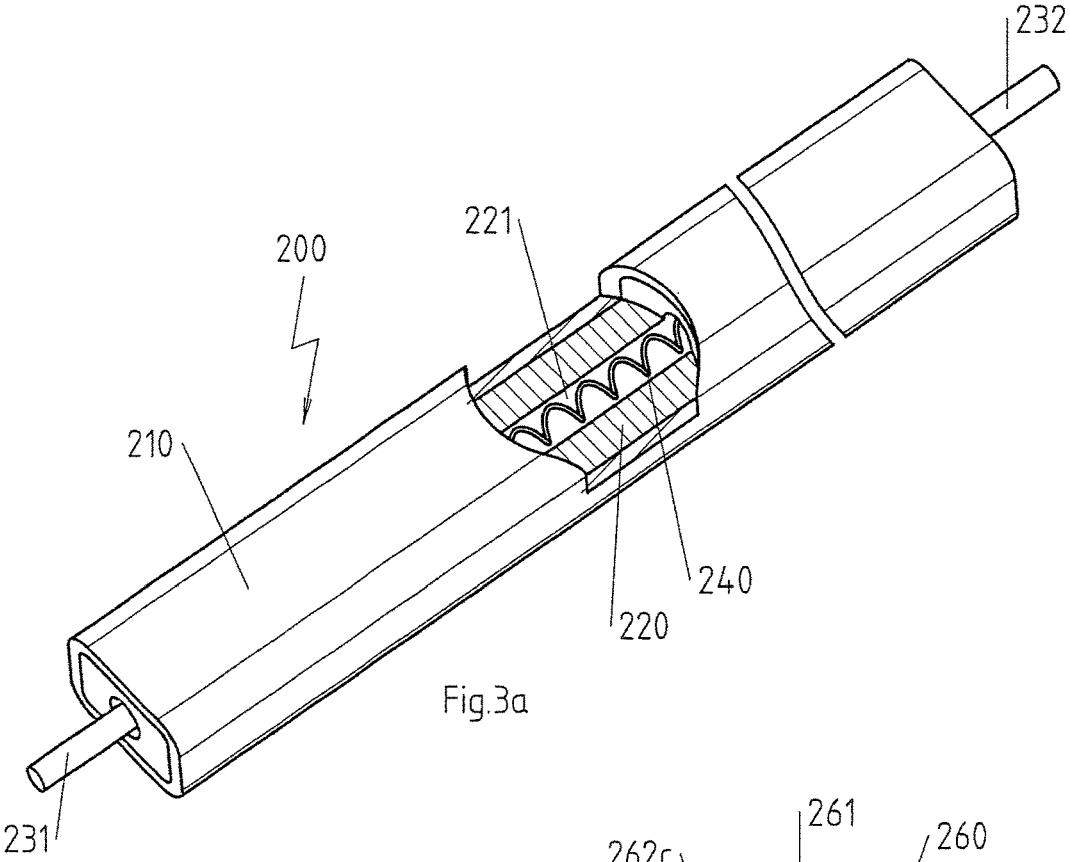
FIG. 3*a* is a partially open perspective view showing an exemplary embodiment of an electrical device in the form of a second heating cartridge.
Figure 3B:
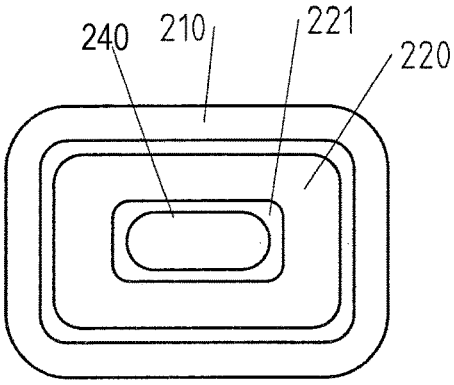
FIG. 3*b* is a cross sectional view taken through the exemplary embodiment from FIG. 3*a* at right angles to the direction in which it extends.

FIGS. 3*a* and 3*b* show an exemplary embodiment of an electrical device in the form of a second heating cartridge 200 with a tubular metal sheath 210, which has an essentially rectangular outer contour.

An insulator body 220 with a tunnel-like opening 221, which has the shape of a rectangle with rounded corners here, is arranged in the interior of the tubular metal sheath. Sections of a first conductor 231 and of a second conductor 232, which are respective terminal studs for power supply, and between which an electrical heating element 240, typically a coiled heating wire embedded in an insulator, not shown here, extends, are inserted each from one side in the tunnel-like opening.

Not only is it ensured by the rectangular configuration of the cross section of the tunnel-like opening, which configuration consequently deviates from the circular shape, that a large cross section is available for the terminal stud, so that an unheated area is formed and efficient working with high currents is facilitated, but a greater heating wire length can also be achieved per turn and hence a higher heat output due to this measure.

Figure 3D:
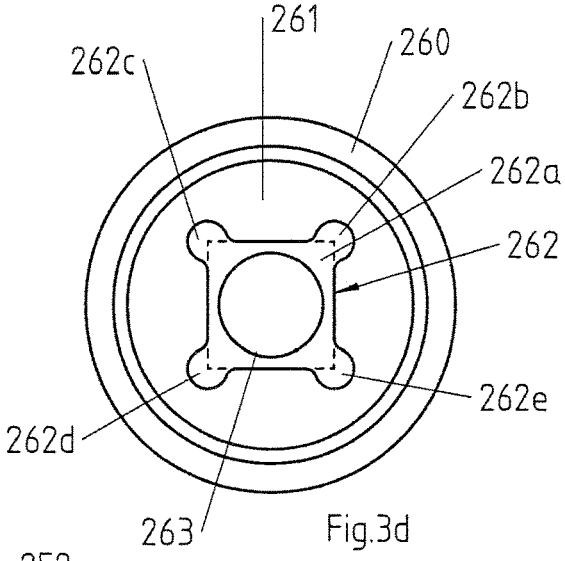
FIG. 3*d* is a cross sectional view through a first variant of the exemplary embodiment from FIG. 3*a*.
Figure 3C:
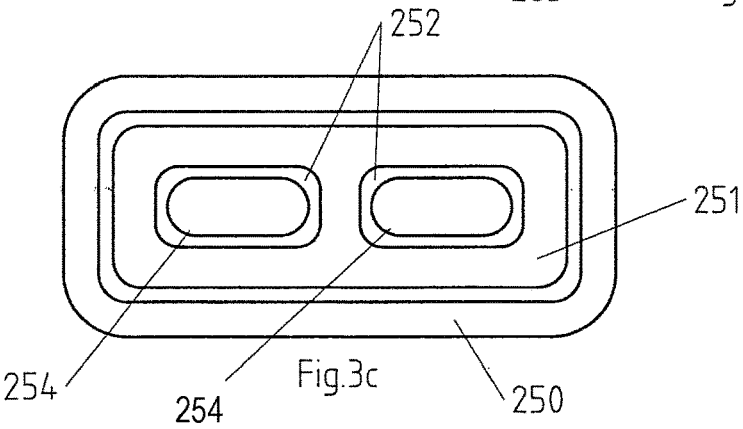
FIG. 3*c* is a cross sectional view through a first variant of the exemplary embodiment from FIG. 3*a*.

FIG. 3*c* shows a cross section through a first variant of the exemplary embodiment from FIG. 3*a*, as it may be used, for example, for an electrical heating device, in which both terminal studs are arranged on the same side. An insulator body 251 is correspondingly received in the tubular metal sheath 250, and the tunnel-like opening 252 in the insulator body, which opening has again an essentially rectangular cross section and sections of terminal studs are received in it, extends in a U-shaped configuration and has oval heating wire coils 254.

In the variant according to FIG. 3*d*, the tubular metal sheath 260 has a circular cross section. The insulator body 261 arranged in the interior of the tubular metal sheath 260 has a tunnel-like opening 262, whose cross section has a square basic shape 262*a*, which is widened at the corners of the square by respective sector-shaped sections 262*b*, 262*c*, 262*d*, 262*e*. A "boundary line" between the square basic shape 262*a* and the sector-shaped sections 262*b*-262*e* is shown by dashed lines for illustration.

A section of a first conductor and the heating wire coil 263 are arranged in the interior of the tunnel-like opening 262 in the area of the square basic shape 262*a*. The sector-shaped sections 262*b*-262*e* support the filling of the tunnel-like opening 262 with an electrically insulating material having good heat conductivity, e.g., magnesium oxide.

While specific embodiments of the invention have been shown and described in detail to illustrate the application of the principles of the invention, it will be understood that the invention may be embodied otherwise without departing from such principles.

APPENDIX

List of Reference Numbers

100, 200 Electrical device
110, 210, 250, 260 Tubular metal sheath
111 Bottom
112 Plug
120, 160, 220, 251, 261 Insulator body
121, 122, 161, 162, 221, 252, 262 Tunnel-like opening
131, 132, 171, 172, 231, 263 First electrical conductor
131*a*, 132*a*, 171*a*, 172*a* Section
133, 134 Supply line
140, 232 Second electrical conductor
140*a*, 140*b* Section
150 Electrically insulating material
173, 240 Electrical heating element
174, 175 Contact point
254, 263 Heating wire coil
262*a* Square basic shape
262*b*, 262*c*, 262*d*, 262*e* Sector-shaped section
300, 310, 320, 330, 340, 350, 360, 370, 380, 390, 400 Insulator body
301, 302, 311, 312, 321, 322, 331, 332, 341, 342, 343, 344, 351, 352, 353, 354, 361, 362, 371, 372, 381, 382, 391, 392, 401, 402, 403, 404 Tunnel-like opening
305, 306, 315, 316, 325, 326, 335, 336, 337, 345, 346, 347, 355, 356, 365, 366, 375, 376, 377, 385, 386, 395, 396, 405, 406, 407, 408 Conductor

What is claimed is:

1. An electrical device comprising:

a tubular metal sheath;

an insulator body arranged in an interior of the tubular metal sheath, at least a first opening and a second opening passing through the insulator body, the first opening comprising a first opening size, the second opening comprising a second opening size, the first opening size being greater than the second opening size;

a first electrical conductor comprising a first electrical conductor cross section, wherein at least one section of the first electrical conductor is arranged in the first opening, a cross-sectional geometry of the first opening deviating from a circular shape, wherein the cross section of the first opening is selected to be such that a ratio of a length of a circumferential line of the cross section to an area of the cross section is maximized for a given installation space;

a second electrical conductor comprising a second electrical conductor cross section, the second electrical conductor cross section being smaller than the first electrical conductor cross section, at least one section of the second electrical conductor being arranged in the first opening.

2. The electrical device in accordance with claim 1, wherein the first opening comprises a first opening area and a second opening area, the first opening area comprising a first opening area dimension, the second opening area comprising a second opening area dimension, the first opening area dimension being greater than the second opening area dimension, the at least one section of the first electrical conductor being arranged in the first opening area, the section of the second electrical conductor being arranged in the second opening area.

3. The electrical device in accordance with claim 1, wherein a cross-sectional geometry of the first opening is adapted to the cross-sectional geometry of the section of the first electrical conductor and the section of the second electrical conductor arranged in the first opening, the first opening being located at a spaced location from the second opening.

4. The electrical device in accordance with claim 1, wherein the cross-sectional geometry of the first opening is adapted to the cross-sectional geometry of the section of the first electrical conductor and the section of the second electrical conductor arranged in the first opening such that the section of the first electrical conductor and the section of the second electrical conductor arranged in the first opening are positioned or fixed or positioned and fixed by the cross-sectional geometry of the tunnel opening.

5. The electrical device in accordance with claim 4, wherein the cross-sectional geometry of the first opening is adapted to the cross-sectional geometry of the section of the first electrical conductor and the section of the second electrical conductor arranged in the first opening such that the section of the first electrical conductor and the section of the second electrical conductor that are positioned or fixed or positioned and fixed in the first opening are arranged essentially gap-free in relation to one another.

6. The electrical device in accordance with claim 4, wherein the cross section of the first opening has a circle segment-shaped or sector-shaped section for receiving and fixing the section of the first electrical conductor and the section of the second electrical conductor having a circular cross section.

7. The electrical device in accordance with claim 4, wherein:

the cross section of the first opening has a circle segment-shaped or sector-shaped section for receiving and fixing the section of the first electrical conductor having a circular cross section or receiving and fixing the section of the second electrical conductor having a circular cross section or receiving and fixing both the section the first electrical conductor having a circular cross section and the section of the second electrical conductor having a circular cross section.

8. The electrical device in accordance with claim 4, wherein the cross section of the first opening has a rectangular section for receiving and fixing the section of the first electrical conductor and the section of the second electrical conductor having a rectangular cross section.

9. The electrical device in accordance with claim 4, wherein:

the cross section of the first opening has a rectangular section for receiving and fixing the section of the first electrical conductor having a rectangular cross section or for receiving and fixing the section of the second electrical conductor having a rectangular cross section or for receiving and fixing both the section of the first electrical conductor having a rectangular cross section and the section of the second electrical conductor having a rectangular cross section.

10. The electrical device in accordance with claim 1, wherein the cross section of the first opening has an angular or curved shape, the section of the first electrical conductor and the section of the second electrical conductor extending an entire length of the first opening.

11. The electrical device in accordance with claim 1, wherein the cross section of the first opening has at least one tapering section.

12. The electrical device in accordance with claim 1, wherein the electrical device is a sheathed thermocouple.

13. The electrical device in accordance with claim 1, wherein the electrical device is an electrical heating device comprised of a heating cartridge or a coiled tube cartridge.

14. The electrical device in accordance with claim 13, further comprising an electrical heating element wound in at least some sections on an outer circumference of the insulator body and protruding in at least some sections into the first opening.

15. The electrical device in accordance with claim 13, wherein the electrical heating device has an electrical heating element, which is arranged entirely in the first opening.

16. The electrical device in accordance with claim 1, wherein the cross section of the first opening has recesses for filling the tunnel opening with a powder comprising magnesium oxide powder.

17. The electrical device in accordance with claim 1, wherein the electrical conductor has a cross section that varies over a length thereof.

18. The electrical device in accordance with claim 1, wherein the cross section of the first opening varies over a length thereof.

19. An electrical device comprising:

a tubular metal sheath;

an insulator body arranged in an interior of the tubular metal sheath, the insulator body defining a first opening and a second opening, the first opening comprising a first opening size, the second opening comprising a second opening size, the first opening size being greater than the second opening size, wherein a cross-sectional geometry of the first opening is not a circular shape, wherein a cross section of the first opening has a first cross-sectional area and a second cross-sectional area, the first cross-sectional area having a size that is greater than a size of the second cross-sectional area;

a first conductor having at least a first conductor section arranged in the first cross-sectional area, the first conductor comprising a first conductor cross-sectional dimension;

a second conductor having at least a second conductor section arranged in the second cross-sectional area, the second conductor comprising a second conductor cross-sectional dimension, the second conductor cross-sectional dimension being less than the first conductor cross-sectional dimension.

20. The electrical device in accordance with claim 19, wherein the cross section of the first opening is selected to be such that a ratio of a length of a circumferential line of the cross section to an area of the cross section is maximized for a given installation space, the first conductor section being adjacent and parallel to the second conductor section, the second conductor having a length equal to at least a length of the first conductor, the second conductor comprising another section extending outside of the first opening and the second opening, the second conductor comprising a radially extending section, the another section of the second conductor being connected to the section of the second conductor via the radially extending section.

* * * * *